US005152706A

United States Patent [19]

Fister

[11] Patent Number: 5,152,706

[45] Date of Patent: Oct. 6, 1992

[54] FLOTATION SUIT FOR THE DISABLED

[76] Inventor: Christie L. Fister, 1580 Bud Arthur Bridge Rd., Spartanburg, S.C. 29302

[21] Appl. No.: 751,541

[22] Filed: Aug. 29, 1991

[51] Int. Cl.[5] ..... B63C 9/115

[52] U.S. Cl. ..... 441/106; 441/119; 441/120

[58] Field of Search ..... 441/102, 103, 104, 106, 441/112, 114–120, 123, 88

[56] References Cited

U.S. PATENT DOCUMENTS

| | | | |
|---|---|---|---|
| 1,498,092 | 6/1924 | Green | 441/102 |
| 1,504,916 | 8/1924 | Teiber | 441/102 |
| 1,562,720 | 11/1925 | Pettee et al. | 441/102 |
| 2,521,205 | 9/1950 | David | 441/117 X |

*Primary Examiner*—Sherman Basinger
*Attorney, Agent, or Firm*—Richard C. Litman

[57] ABSTRACT

A floatation suit for physically disabled persons includes a jacket, pants, and outrigger floatation members. The outriggers prevent the wearer from tilting or rotating and assist in floatation. By selectively affixing long and short outriggers to both or either the jacket or pants, the degree and location of buoyancy will be controllable. A collar floatation member is attachable to the jacket to stabilize the wearer's head and neck. All components are constructed so as to allow the disabled person to float in the water for recreational and therapeutic purposes, while maintaining the wearer's body in a desired position.

9 Claims, 1 Drawing Sheet

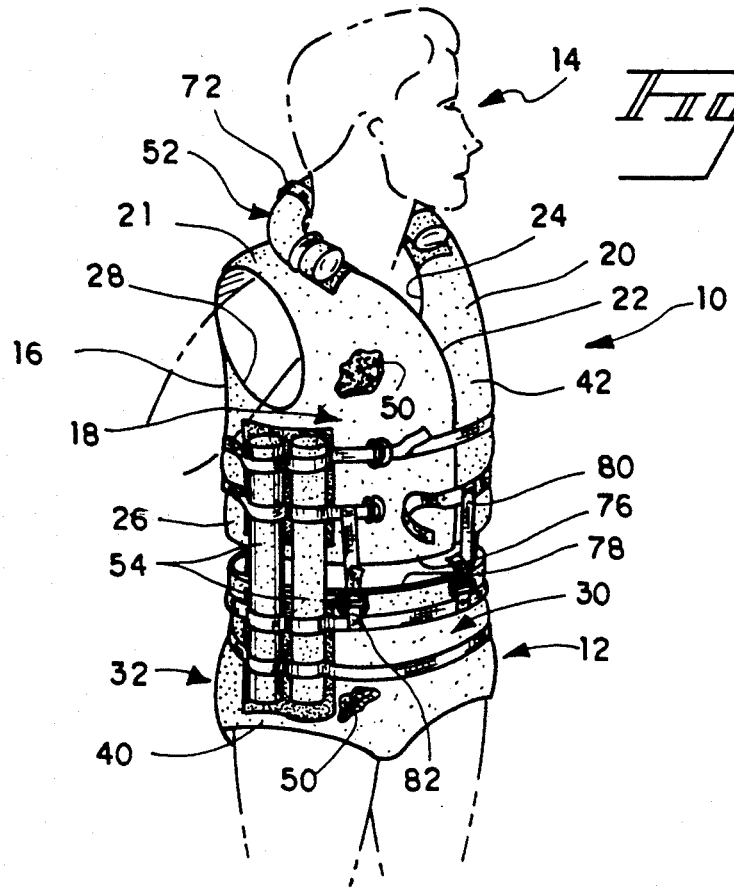
Fig 1
Fig 3
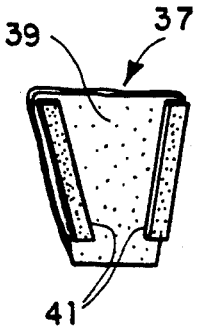
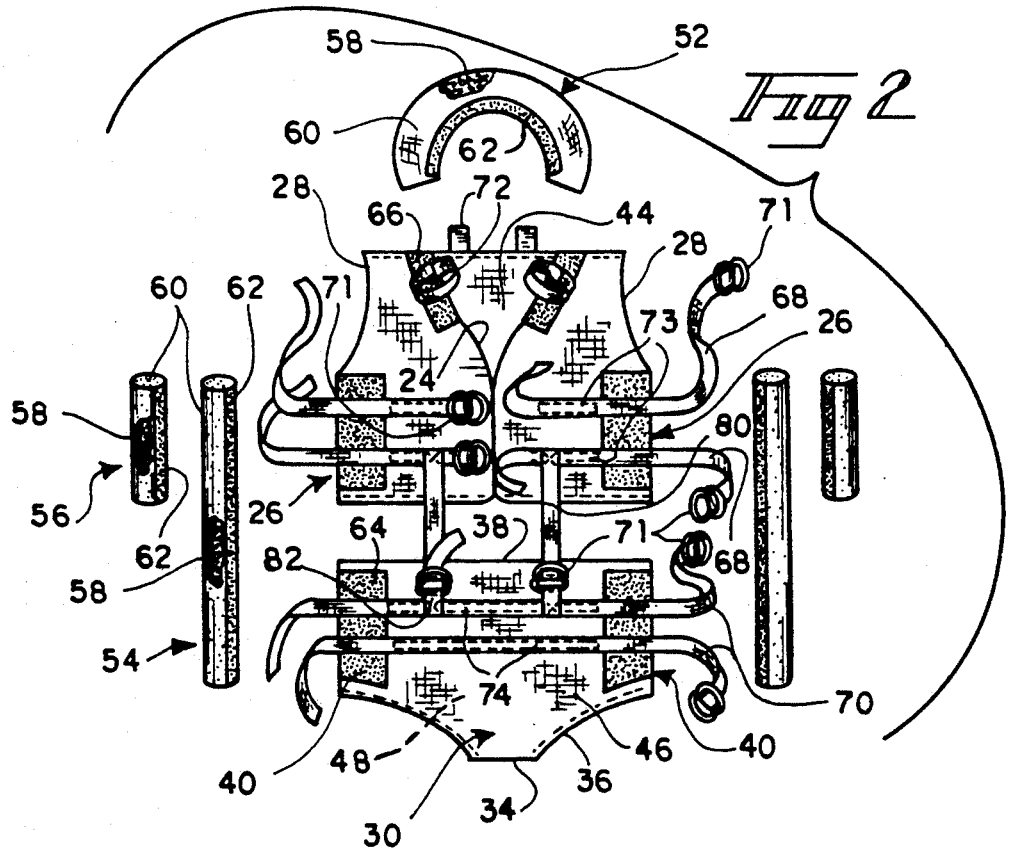
Fig 2

FLOTATION SUIT FOR THE DISABLED

This invention relates generally to flotation devices and more particularly, to an improved flotation system especially useful by persons with physical disabilities.

BACKGROUND OF THE INVENTION

For many people, swimming provides recreational enjoyment and serves as a beneficial therapeutic activity. For many handicapped individuals, though, swimming, or even being in the water, seems like an impossibility. Individuals with physical disabilities often experience difficulty in floating and stabilizing their bodies while swimming or taking aquatic instruction or receiving therapy.

Although numerous types of flotation garments or the like are available, the need exists for floatation augmentation means particularly adapted for use by handicapped individuals and which permits ready adaptation to various situations and needs.

DESCRIPTION OF THE RELATED ART

Numerous buoyant garments have been provided to keep the wearer afloat. U.S. Pat. Nos. 3,098,248; 3,838,471; and 4,619,622 all are illustrative of such prior devices. While these garments may be suitable for the particular use they address, they would not be suitable for the purpose of the present invention as heretofore described.

None of the above examples, however, shows the combination of a plurality of garments interconnected to each other by replaceable outriggers or floatation elements to provide enhanced stability to a wearer while in the water.

SUMMARY OF THE INVENTION

The present invention provides means of floatation to those who are physically handicapped or to those who desire to learn swimming under safe conditions. Dual garments are proposed, each with fastening means allowing of the selective attachment of various lengths of elongated floatation elements to provide alternative flotation characteristics.

An object, advantage, and feature of the invention is to provide a unique floatation suit, particularly beneficial for persons who are physically disabled.

Another object, advantage, and feature of the invention is to provide an improved floatation suit having variable elements to stabilize a person in water in order to achieve and maintain a desired posture in the water.

Another object, advantage, and feature of the invention is to provide a floatation garment having a buoyant detachable collar.

Another object, advantage, and feature of the invention is to provide an improved floatation vest having means for the selective attachment of the extenders or outriggers as used to provide for controlled floatation.

Another object, advantage, and feature of the invention is to provide an improved swimming pants or trunks having means for the attachment of auxiliary floatation extenders.

Another object, advantage, and feature of the invention is to provide an improved floatation system including a disparate pair of garments, each having fastening means allowing for the selective attachment of one or more elongated floatation members to either or both of the garments.

These and other objects in view, the advantages, and features of the invention will become apparent from the description, claims, and drawings herein wherein similar reference characters refer to similar parts throughout.

BRIEF DESCRIPTION OF THE DRAWINGS

FIG. 1. A perspective view of the floatation suit according to the invention;

FIG. 2 is an exploded front elevation illustrating the suit of FIG. 1 and the numerous floatation elements which may be selectively affixed to the suit components; and FIG. 3 is a plan view of an extender element usable with either suit component to enlarge the size thereof.

DETAILED DESCRIPTION OF THE PREFERRED EMBODIMENT

Referring now to the drawings, particularly FIG. 1, the flotation assembly of the invention will be seen to include upper and lower garments 10 and 12, respectively. The upper garment 10 is intended to encompass the trunk section of a user 14 and preferably defines the configuration of a sleeveless jacket or vest while the lower garment 12 comprises a pair of shorts or briefs.

The upper garment 10 may be fabricated either as a true vest or as a mantle. The latter construction may be more feasible in those cases wherein a user's disability prevents them from moving their arms outwardly enough to pass them through a garment's armholes. In any case, the vest or upper garment 10 comprises a back panel 16 cooperating with right and left front panels 18,20 respectively, and joined at the shoulders 21 with the panels 18, 20 having free edges 22, 22 adapted to abut or overlap. These edges will be seen to extend upwardly to form a neckline 24. The vest provides side portions 26, 26 at the juncture of the front panels 18, 20 and the back panel 16 and which are beneath a pair of armholes 28, 28.

The briefs or lower garment 12 likewise may comprise alternative configurations but in any case includes a front section 30 joined to a back section 32 by an intermediate crotch section 34, such that a pair of leg openings 36, 36 are formed, along with a top opening 38. At the juncture of the front and back sections, side portions 40, 40 are formed. This garment 12 may comprise a step-in type of garment or, a flattened hour-glass shaped member adapted to be applied to a user in a manner similar to a disposable diaper. Again, the latter embodiment may be more convenient for application upon persons with certain types of disabilities. In any case, the wearing, primary features and function of the present flotation system will be similar, regardless of whether the two garments 10, 12 are intended to be pulled on and stepped into or, draped upon the respective areas of a wearer's body.

With either or both the upper and lower garments 10, 12, the sides may be secured by means of overlapping portions provided with VELCRO. In this manner, size alteration of the respective garments is readily accomplished by the use of triangular extenders 37 as shown in FIG. 3 and which include a triangular-shaped fabric body 39 having VELCRO strips 41 adapted to cooperative with mating strips on the garment 10 or 12.

The basic construction of both garments 10, 12 is generally similar in that each comprises two layers of fabric with a layer of buoyant material sandwiched therebetween. The outer and inner layers 42, 44 respectively of the upper garment 10 as well as the outer and inner layers 46, 48 of the lower garment 12 may comprise any suitable natural or synthetic fabric, preferably one that exhibits water repellency. Between each pair of fabric layers 42, 44 and 46, 48 in the garments 10, 12 is an intermediate layer 50 of buoyant or flotation composition comprising any well known material. Although natural material such as kapok may be employed, it is preferable to use expanded synthetic foam material in view of its consistency and the ease of inserting unitary sheets of such material between the fabric layers 42, 44 and 46, 48.

Although garments 10 and 12 as above described will obviously provide a wearer or user 14 with a substantial degree of flotation, the present invention provides means for enhancing the usefulness of either or both garments 10 and 12 while enabling the selection, alteration, or augmentation of the degree of buoyancy. In this manner, the flotation characteristics applicable to each particular user 14 may be customized in accordance with their disability or, the dictates of the specific type of water training involved. The above is provided by means of selectively usable flotation augmentation members and which are adapted to be releasably affixed to either or both garments 10, 12 at key points designed to supplement the buoyancy as provided by the garments 10,12 themselves.

To enhance the buoyancy of a user 14 in the area of their head, it is proposed to provide an elongated substantially U-shaped flotation member comprising a neck-piece 52. Additionally, flotation members comprising elongated substantially straight outriggers 54, 56 are provided to offer further buoyancy along the sides of a user. By the selective employment of either one or pairs of the short outriggers 56 or the long outriggers 54 on both sides, added buoyancy may be provided either to the wearer's trunk area or the waist/hip area or, to both areas. The above flotation members 52, 54, 56 will be understood to comprise any suitable buoyant composition, either of natural or synthetic material. Expanded synthetic foam composition such as well known sleeve-type pipe insulation 58, readily lends itself to fabrication of the flotation members 52, 54, 56. If such convenient material is used, two such sleeves 60 may be rolled one within the other, to provide maximum buoyancy within a minimal circular cross-sectional area. Obviously, other configurations may be used such as solid cylindrical rods of buoyant composition. The buoyant composition 58 is encased within a sleeve or housing 60 fully covering the contained buoyant composition.

Each flotation member 52, 54, 56 is releasably attachable to either of the garments 10, 12 by two different means. First, a strip 62 of one fastening component of VELCRO, is secured along the full length of the flotation member sleeve 60, as shown most clearly in FIG. 2 of the drawings. This attachment may be made by means of an adhesive, stitching or the like and allows separable attachment of any of the flotation members 52, 54, 56 when this component 62 is engaged with elongated patches or strips 64, 66 of a second VELCRO fastening component and which are likewise suitably secured to the garment item. In the case of the fastening components 64, these will be seen to be vertically disposed along the side portions 26 and 40 of the upper and lower garments 10, 12 respectively, while the fastening component 66 is secured about the neckline 24 of the upper garment 10.

In each instance, when the elongated flotation members 52, 54 and 56 are secured to the garment(s) 10, 12 as in FIG. 1, by cooperative engagement of the mating VELCRO components 62, 64, 66, supplemental fastening means are utilized to insure retention of the members 52, 54, 56 in place during subsequent body movement or water activity. In the case of the vertical outriggers 54, 56, this comprises the passage of horizontal or transverse webbing or straps 68, 70 about the wearer's body to captively and tightly urge the outriggers 54, 56 into engagement with the garment. These straps 68, 70 will be understood to serve double duty as they not only further retain the flotation members 54, 56 but also secure the respective garment 10, 12 to the wearer. The free ends of these straps 68, 70 are adapted to be releasably joined by any well known means such as D-rings 71 or other fasteners which permit an adjustable connection.

In the case of the outrigger flotation members 52, 54, 56, the shorter members 56 may be affixed to either of the garments 10,12 by attachment to the respective fastener components 64 or, by using the longer flotation members 54, the opposite ends of each may be affixed to the two garments 10, 12 in a bridging fashion as shown in FIG. 1 of the drawings. With such flexibility, one may alter or custom adapt the buoyancy rate and locus of flotation for any one wearer of the instant apparatus, by selecting the size and placement of the flotation members 52, 54, 56, so that the ideal stabilization of the particular wearer in water is achieved.

The neckpiece flotation member 52 is likewise selectively attachable along the upper garment neckline 24 by engaging the cooperative fastener components 62, 66 and as in the case of the outrigger members 54, 56, strap elements 72 carried by the vest 10, are then passed around the attached neckpiece 52 to positively retain the flotation member in place. The respective ends of each strap assembly 72 may also be provided with mating VELCRO components to permit accommodation of neckpieces of varying diameters.

When both of the garments 10 and 12 are being worn, with or without the various flotation members 52, 54, 56, means are provided to interlock the two garments 10, 12 against axial separation. The front of the horizontal straps 68 and 70 will be seen to be stitched or otherwise fixed to the respective garments as at 73, 74. From the horizontal straps closest to the garment waist-line 76,78, a pair of vertical straps 80 or 82 extend toward the opposite garment. With this arrangement, the straps 80, 82 of the two garments 10, 12 may be adjustably connected together, as by D-rings 71 or other fasteners permitting of strap adjustment and thus firmness of fit of the associated garments 10, 12.

It is to be understood that the present invention is not limited to the sole embodiment described above, but encompasses any and all variations falling within the scope of the appended claims.

I claim:

1. A buoyancy suit comprising;

a body encircling garment including inner and outer fabric layers containing a buoyant composition therebetween, said garment provided with side portions including first separable fastener components, an elongated flotation member having second separable fastener components thereon mating with said first separable fastener components, and an elongated flexible strap element having an intermediate portion affixed to said garment in a substantially horizontal disposition and provided with end portions removably and adjustably attachable to one another, and said flotation member attachable to either said garment side portion through engagement of said fastener components with said flexible strap element passing over said flotation member to captively retain said flotation member attached to said side portion.

2. A buoyancy suit according to claim 1 wherein, said garment comprises a vest.

3. A buoyancy suit according to claim 2 including, a neckline on said vest having first separable fastener means thereon, an elongated flotation collar having second separable fastener means thereon matable with said first separable fastener means to attach said collar to said vest neckline, and strap means on said vest neckline operable to envelope said collar when attached to said vest, to captively retain said collar.

4. A buoyancy suit according to claim 1 wherein, said garment comprises a pair of trunks.

5. A buoyancy suit according to claim 1 wherein, said garment includes a pair of wearing articles comprising a vest and trunks.

6. A buoyancy suit according to claim 5 wherein, said elongated flotation member includes opposite ends respectively attached to said vest and trunks.

7. A buoyancy suit according to claim 5 including, vertical strap elements attached to said intermediate portion affixed to said garment in a substantially horizontal disposition and respectively attachable to one another.

8. A buoyancy suit according to claim 5 including, extender elements attachable to said vest and trunks to alter the size thereof.

9. A buoyancy suit according to claim 1 wherein, said elongated flotation member comprises a substantially cylindrical element including buoyant material surrounded by a sleeve of fabric.

* * * * *